US006724285B1

(12) United States Patent
Zehrung

(10) Patent No.: US 6,724,285 B1
(45) Date of Patent: Apr. 20, 2004

(54) MONITOR HINGE

(76) Inventor: Raymond E. Zehrung, 131 Serena Way, Santa Clara, CA (US) 95051

( * ) Notice: Subject to any disclaimer, the term of this patent is extended or adjusted under 35 U.S.C. 154(b) by 0 days.

(21) Appl. No.: 10/050,723

(22) Filed: Jan. 14, 2002

(51) Int. Cl.[7] ..... H01H 9/00
(52) U.S. Cl. ..... 335/205; 335/207; 340/547
(58) Field of Search ..... 335/205–207; 340/543, 545.1–545.7, 561, 551

(56) References Cited

U.S. PATENT DOCUMENTS 3,715,537 A 2/1973 Peterson
3,806,852 A * 4/1974 Suska ..... 335/205
3,896,404 A * 7/1975 Peterson ..... 335/205
4,072,917 A * 2/1978 Haag et al. ..... 335/205
4,148,001 A * 4/1979 Gwozdz ..... 335/205
4,186,362 A 1/1980 Kondo et al.
4,211,990 A 7/1980 Gwozdz
4,456,897 A * 6/1984 Holce et al. ..... 335/205
4,700,163 A 10/1987 Wolfe, Jr.
4,903,010 A 2/1990 Greene
6,577,235 B2 * 6/2003 Frys ..... 340/547

* cited by examiner

*Primary Examiner*—Lincoln Donovan
(74) *Attorney, Agent, or Firm*—David R. Gildea

(57) ABSTRACT

A monitor hinge having a magnet plug and a magnetic switch plug. The magnet plug and magnetic switch plug have countersink heads to seat in the hinge fastening holes and insert through juxtaposed hinge holes into drilled holes in the door and wall jambs.

48 Claims, 6 Drawing Sheets

MONITOR HINGE

BACKGROUND OF THE INVENTION

1. Field of the Invention

The invention relates generally to door hinges and more particularly to door hinges for detecting whether a door is open or closed.

2. Description of the Prior Art

There are several situations where it is necessary to monitor whether a door is open or closed. Examples of such situations are turning a light on or off and managing building security to name a few. In some cases it is desirable to disguise the device that performs the monitoring in order to reduce the likelihood of tampering.

One approach for monitoring the state of a door uses a push button switch in a wall jamb. The push button is depressed by the doorjamb when the door is closed and is released otherwise. Although this approach is common in automobiles, its use for managing building security has been limited because the push button is exposed and therefore more likely to be tampered with and because it requires a custom installation of an additional part. The same issues limit the use of a reed relay and a magnet in place of the push button switch. Many attempts have been made over the years to improve upon these approaches by using a custom door hinge having a rotation sensitive switch hidden within the knuckles of the hinge. Unfortunately, such hinges have been costly due the extensive machining that has been required and they have not proven to be reliable. Another attempt has been made to resolve these issues by hiding the reed relay and magnet in cavities milled or cut into the jambs behind the hinge leaves. Unfortunately, the additional installation for this approach is costly because custom milling or cutting is required for the cavities. Further, it is not suitable for a steel hinge unless a non-magnetic insert is made in the hinge in the area covering the magnet and the switch. Making such insert increases the cost still more.

There remains to be a need for an inexpensive monitor hinge that is easy to install.

SUMMARY OF THE INVENTION

It is therefore an object of the present invention to provide an inexpensive monitor hinge using a magnet plug and a magnetic switch plug where the plugs have the installed appearances of hinge fastening screw heads. The monitor hinge of the present invention is inexpensive to install because the magnet plug and the magnetic switch plug are inserted through standard hinge fastening holes into round holes in door and wall jambs that may be drilled with a conventional drill bit.

It is another object of the present invention to provide a conversion kit having a magnet plug and a switch plug that may be used for converting standard hinges into monitor hinges.

Briefly, in a preferred embodiment, the monitor hinge of the present invention includes a hinge, a magnet plug having a magnet, and a switch plug having a magnetic field sensitive switch. The magnet plug and the switch plug replace two hinge fastening screws in mirror image positions when the hinge is open and mirror image juxtaposed positions when the hinge is closed. The magnet and switch plug housings have countersink heads with cross notches that seat in countersink hinge fastening holes and give the appearance of hinge fastening screws. The bodies of the magnet and switch plugs are cylindrical and have dimensions to pass through standard hinge fastening holes so that the plugs can be inserted into holes in the jambs that are drilled before or after the hinge is installed.

These and other objects and advantages of the present invention will no doubt become obvious to those of ordinary skill in the art after having read the following detailed description of the preferred embodiments which are illustrated in the various figures.

IN THE DRAWINGS

DETAILED DESCRIPTION OF THE PREFERRED EMBODIMENTS

Figure 1:
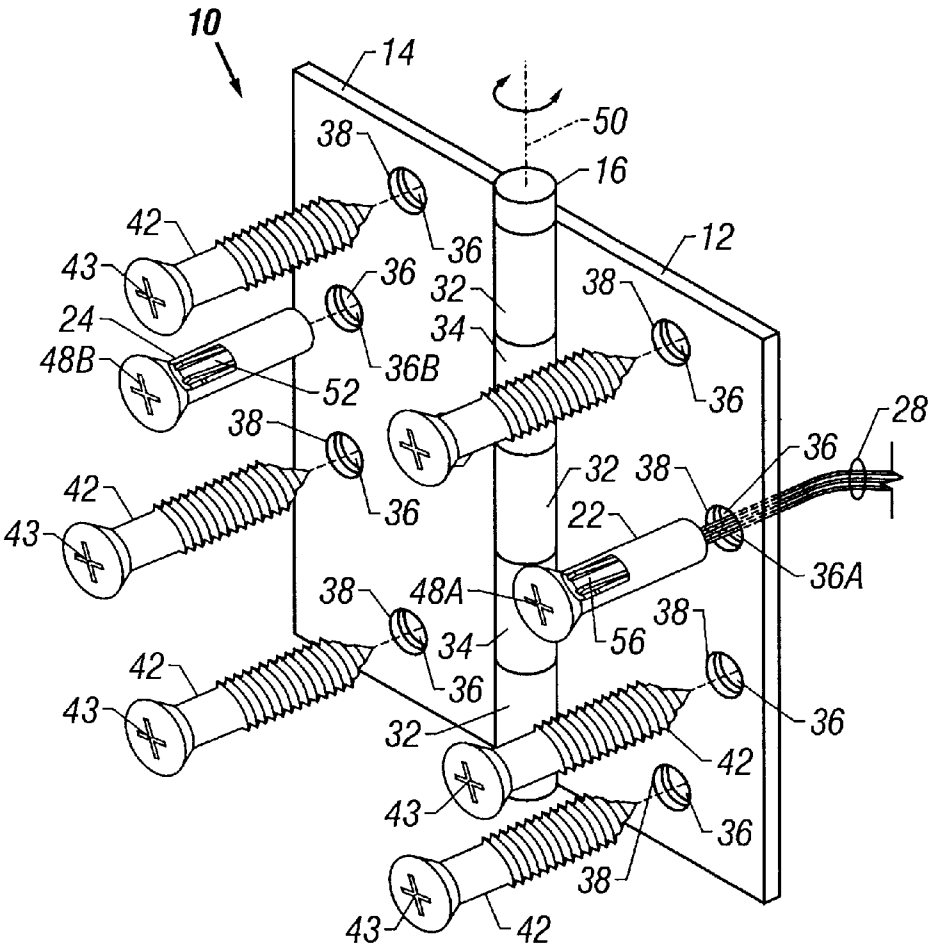
FIG. 1 is a perspective drawing of the monitor hinge of the present invention with the hinge open.
Figure 4:
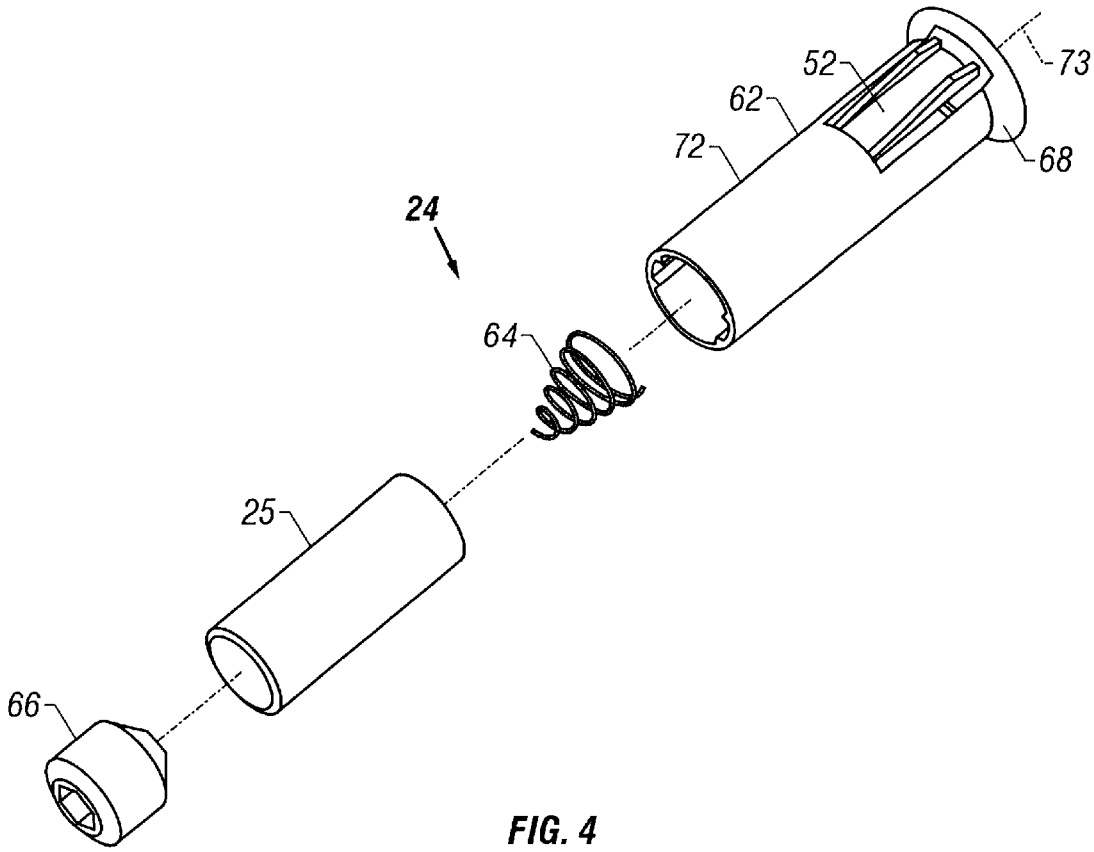
FIG. 4 is an assembly drawing of a magnet plug of the hinge of FIGS. 1 and 2.
Figure 5:
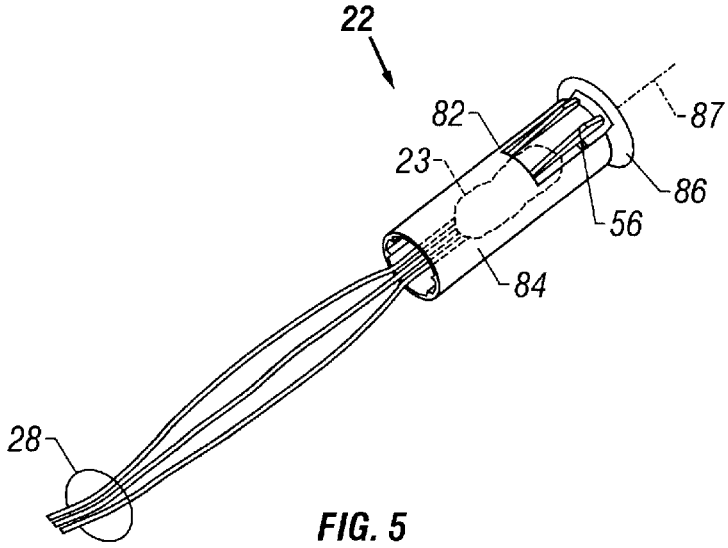
FIG. 5 is a perspective view of a switch plug of the hinge of FIGS. 1 and 2.

FIG. 1 is a perspective assembly view of a monitor hinge of the present invention referred to by the general reference number 10. The monitor hinge 10 includes first and second hinge leaves 12 and 14, a center pin 16, a switch plug 22, and a magnet plug 24. The magnetic plug 24 includes a magnet 25 (FIG. 4). The switch plug 22 includes a magnetic field sensitive switch 23 (FIG. 5). Electrical wires 28 provide an electric connection between contacts within the switch 23 (FIG. 5) and an external system such as a security system, a system for detecting possible entry or exit, a light, an alarm, a fire control system, and environmental system, or the like.

The first hinge leaf 12 includes one or more first knuckles 32. The second hinge leaf 14 includes one or more second knuckles 34. The pin 16 passes through the first and second knuckles 32 and 34 for rotationally connecting the first and second hinge leaves 12 and 14. The hinges leaves 12 and 14 have fastening holes 36 having countersink rings 38. Countersink screws 42 having screwdriver drive notches 43 pass through the fastening holes 36 to fasten the monitor hinge 10 to a first hinge object shown in FIG. 3 as a wall jamb 44 and second hinge object shown in FIG. 3 as a door jamb 46. Preferably, in order to camouflage the monitoring aspect of the hinge 10, the switch and magnet plugs 22 and 24 have cross notches 48A and 48B, respectively, having the appearance similar to the screwdriver drive notches 43.

The switch plug 22 and the magnet plug 24 are inserted through a mirror image pair 36A and 36B of the fastening holes 36. Any pair of the fastening holes 36 that form a mirror image about a center axis 50 of the pin 16 may be selected as the mirror image fastening holes 36A and 36B. Latch fingers 52 on the magnet plug 24 retain the magnet plug 24 in the fastening hole 36B. Latch fingers 56 of the switch plug 22 retain the switch plug 22 in the fastening hole 36A.

In operation, the first and second hinge leaves 12 and 14 rotate about the center axis 50 between an open position and a closed position. FIG. 1 shows the monitor hinge 10 in the open position and the switch and magnet plugs 22 and 24 aligned for insertion in fastening holes 36A and 36B.

Figure 2:
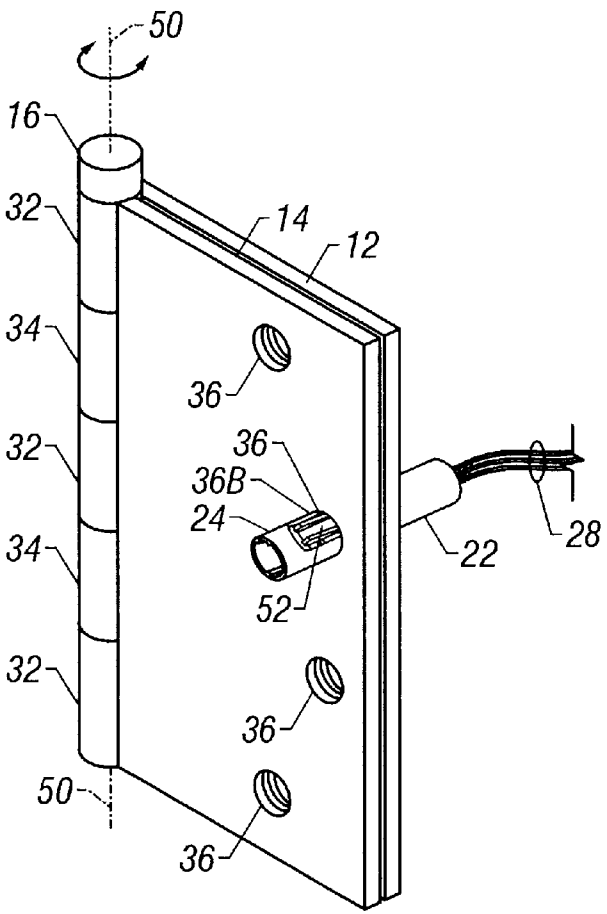
FIG. 2 is a perspective drawing of the monitor hinge of the present invention with the hinge closed.

FIG. 2 shows the monitor hinge 10 in the closed position with the switch and magnet plugs 22 and 24 installed. When the monitor hinge 10 is in the closed position, the magnet plug 24 and the switch plug 22 are juxtaposed.

The magnet 25 (FIG. 4) in the magnet plug 24 provides a magnetic field that increases as the distance to the magnet 25 (FIG. 4) decreases. When the magnet plug 24 and the switch plug 22 are separated by opening the hinge leaves 12 and 14, the relatively small magnetic field received by the switch 23 (FIG. 5) causes the switch 23 (FIG. 5) to take a first electrical state.

When the magnet plug 24 and the switch plug 22 are brought together by closing the hinge leaves 12 and 14, the increased magnetic field received by the field sensitive switch 23 (FIG. 5) causes the switch 23 (FIG. 5) to take a second electrical state. In alternative embodiments, the first and second electric states may be open and closed electrical contacts, respectively; closed and open electrical contacts, respectively; electrical contact between a C terminal and A and B terminals, respectively; or the like. Switches known as reed relays may be used for the magnetic field sensitive switch 23 (FIG. 5). The switch 23 (FIG. 5) may be classed as normally open, normally closed, form C, or the like.

Figure 3:
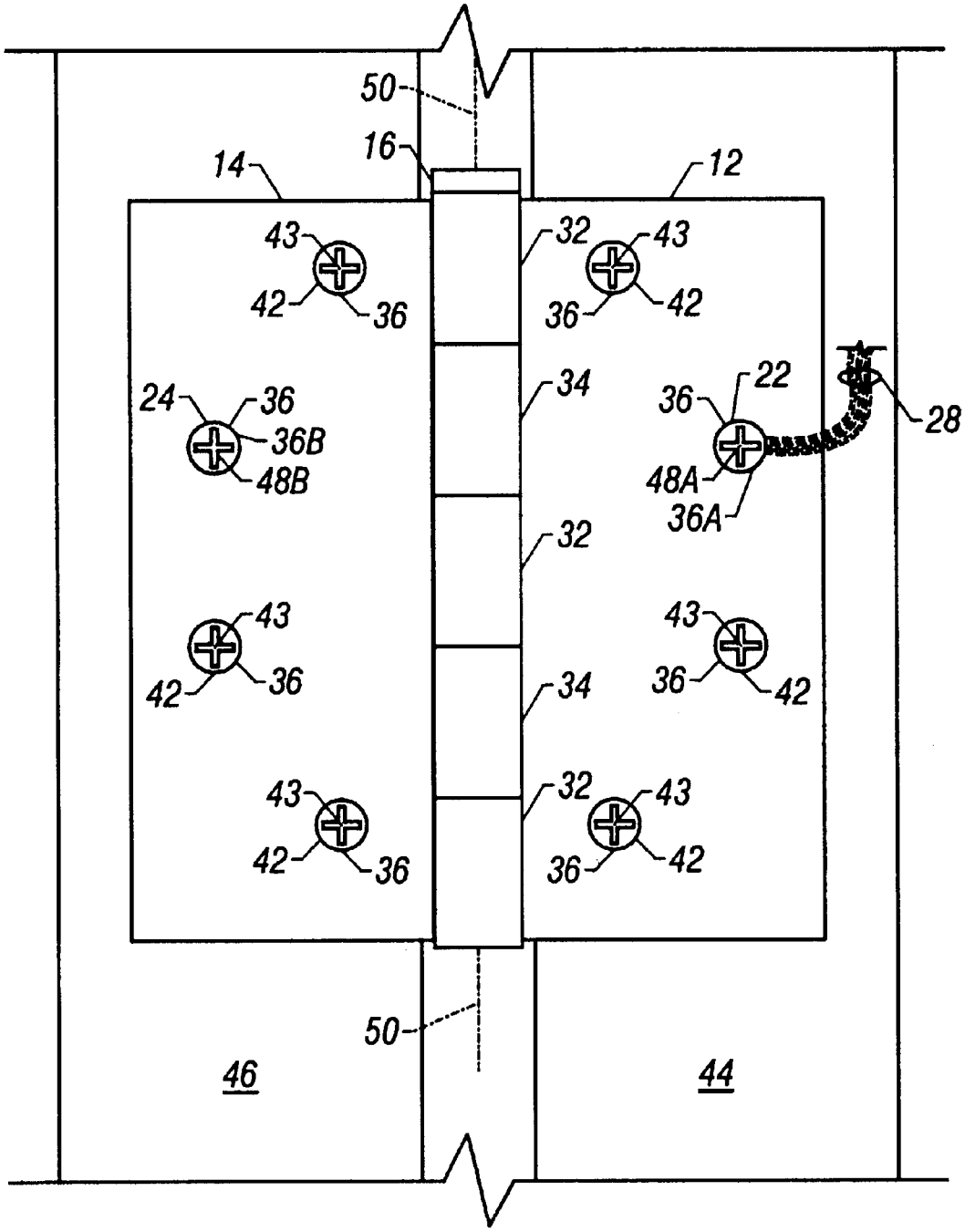
FIG. 3 is a front view of the hinge of FIGS. 1 and 2 installed onto door and wall jambs.

FIG. 3 illustrates the monitor hinge 10 in the open position installed with screws 42 (FIG. 1) through fastening holes 36 to the first hinge object shown the wall jamb 44 and the second hinge object shown as the door jamb 46. It should be noted that the hinge objects can actually be any objects that are to be connected with a hinge. For example the monitor hinge 10 may connect edges or front or rear surfaces of hinge objects such as doors, windows, panels, a wall, or the like. The switch plug 22 is installed through the fastening hole 36A into the wall jamb 44. Of course, their positions could be reversed so that the switch plug 22inserts into the door and the magnet plug 24 inserts into the wall. The magnet plug 24 is installed through the fastening hole 36B into the doorjamb 46. The wires 28 are pushed or fished through the wall jamb 44 to connect into the external system.

FIG. 4 is an assembly drawing of the magnet plug 24 of the present invention. The magnet plug 24 includes the magnet 25, a magnet plug housing 62, a spring 64, and an end plug 66. The housing 62 includes a hollow cylindrical body 72 extending from a countersink head 68. The countersink head 68 seats in the countersink ring 38 of the fastening hole 36B when the monitor hinge 10 is installed.

The housing 62 is molded of an elastic plastic so that the latch fingers 52 compress and/or bend inward when the magnet plug 24 is inserted and then spring back in order to hold the magnet plug 24 in the fastening hole 36B. For fastening holes 36 of a standard diameter of about 5⁄16 inches, the radius of the projection of the latch fingers 52 is in a range of 0.165 to 0.200 inches with respect to a center line 73 of the magnet plug housing 62. Preferably, the plastic is paintable so that the top of the head 68 can be painted to look like a metal screw head. ABS plastic can be used.

The magnet plug 24 is assembled by inserting the spring 64 into the hollow within the body 72, inserting the magnet 25 into the body 72 against the spring 64, and then threading the end plug 66 into the body 72 to press on the magnet 25 and compress the spring 64. Preferably, the end plug 66 has self-tapping threads for cutting threads in the inner surface of the body 72.

The position of the magnet 24 with respect to the head 68 may be adjusted by threading the end plug 66 in or out to the distance between the magnet 25 and the head 68, thereby adjusting the angle of opening of the monitor hinge 10 where the intensity of the magnetic field causes the switch 23 (FIG. 5) to change between first and second electrical states. Typically, for installation on a door of a building, this angle is adjusted so that the switch 23 indicates a door opening of less than two inches. Alternatively, the position of the switch 23 or positions of both the switch 23 and the magnet 25 may be adjusted.

In an alternative embodiment, the diameter of the magnet 25 is a tight fit with the inner diameter of the body 72. The friction of the tight fit holds the magnet 25 in place. The spring 64 and the end plug 66 are not used. The opening angle of the door where the switch 23 changes state is adjusted by moving the magnet 25 inward or outward against the friction of the tight fit.

FIG. 5 is a perspective view of the switch plug 22 of the present invention. The switch plug 22 includes a switch plug housing 82, the magnetic field sensitive switch 23 disposed within the switch plug housing 82, and the wires 28 electrically connected to switch contacts within the switch 23.

The housing includes a cylindrical body 84 extending from a countersink head 86 and latch fingers 56 projecting outward from the body 84. The countersink head 86 seats in the countersink ring 38 of the fastening hole 36A when the monitor hinge 10 is installed.

The housing 82 is molded of an elastic plastic so that the latch fingers 56 compress and/or bend inward when the switch plug 22 is inserted and then spring back in order to hold the switch plug 22 in the fastening hole 36A. For fastening holes 36 of a standard diameter of about 5⁄16 inches, the radius of the projection of the latch fingers 56 is in a range of 0.165 to 0.200 inches with respect to a center line 87 of the switch plug housing 82. Preferably, the plastic is paintable so that the top of the head 86 can be painted to look like a metal screw head. ABS plastic can be used. The end of the body 84 where the wires 28 exit can be potted to hold the switch 23 in place.

It should be noted that the switch plug 22 and magnet plug 24 may be used as a conversion kit for converting a standard hinge into the monitor hinge 10. Hinges defined by the American National Standards Institute, Builders Hardware Manufacturers Association (ANSI/BHMA) are considered within the building industry art as standard hinges. The fastening screws 42 for a typical standard hinge are 12–24 machine screws or #12 wood screws. The switch plug 22 and magnet plug 24 are inserted in place one of the fastening screws 42 in each one of the hinge leaves 12 and 42 as described herein. Templates and installation instructions for such standard hinges are available over the Internet from ANSI/BHMA, from Hagar Companies, or from most major manufacturers of building industry hinges. ANSI has its headquarters is located in Washington, D.C. BHMA has its headquarters located in New York city, N.Y. Hagar Companies has it headquarters in Saint Louis, Mo.

Figure 6:
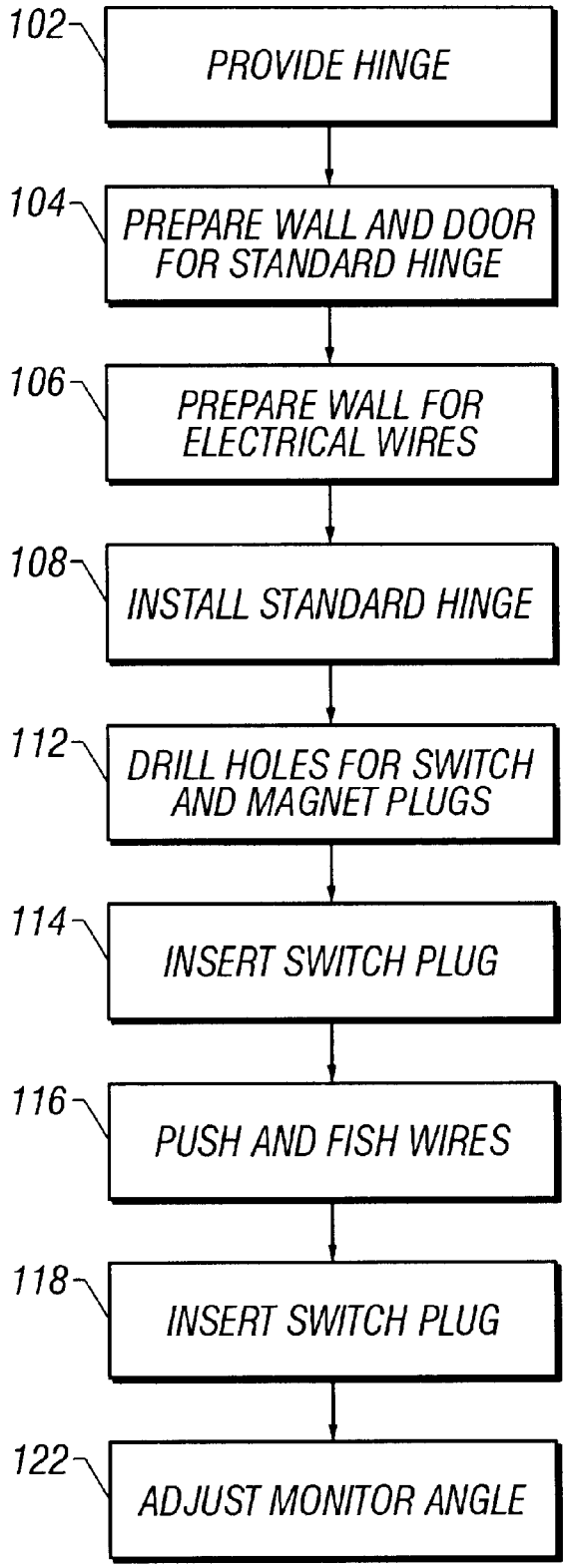
FIG. 6 is a flow chart of an installation method for the hinge of FIGS. 1 and 2.

FIG. 6 is flow chart of a method of the present invention for installing the monitor hinge 10.

In a step 102 the monitor hinge 10 of the present invention is provided by the installer. It should be noted that the hinge leaves 12 and 14, the pin 16, the fastening holes 36, and the screws 42 may be used as a standard (non-monitoring) hinge. A standard non-monitoring hinge may be received from one source while a monitor hinge conversion kit having the switch plug 22 and the magnet plug 24 may be received from another source.

In a step 104 the wall jamb 44 and doorjamb 46 are prepared in a standard manner for the standard hinge leaves 12 and 14, the pin 16, the fastening holes 36, and the screws 42.

In a step 106 a longitudinal passageway that aligns with the selected fastening hole 36A is made in the wall jamb 44 and the wall behind the wall jamb 44 for pushing or fishing the wires 28. It should be noted that the steps 104 and 106 may be performed in either order.

In a step 108 the hinge leaves 12 and 14 and the pin 16 are installed to the wall jamb 44 and the door jamb 46 in a standard manner with the fastening screws 42. Optionally, the fastening screws 42 in the selected mirror image fastening holes 36A and 36B may be omitted at this stage or installed and then backed out. Many standard commercial hinges have fastening holes of approximately 5/16" diameter. The switch plug 22 and magnet plug 24 can be installed into such holes as is without drilling or enlarging the holes.

In a step 112, using only a drill and bit, round holes are drilled through the selected fastening holes 36A and 36B into the wall and door jambs 44 and 46 of sufficient depth into a wall and a door to accept the switch plug 22 and the magnet plug 24.

In a step 114 the switch plug 22 is inserted into the fastening hole 36A. In a step 116 the wires 28 are pushed or fished through the passageway. In a step 118 the magnet plug 22 is inserted into the fastening hole 36B. In a preferred embodiment the switch and magnet plugs 22 and 24 are retained in the monitor hinge 10 by the fingers 52 and 56.

In a step 122 the door is rotated back and forth with respect to the wall and the end plug 66 is adjusted until the opening between the door and the wall where the magnetic field causes the switch 22 to change state is satisfactory. Typically, in a commercial building the opening where the switch 22 changes state is specified to be less than two inches.

Figures 7A, 7B:
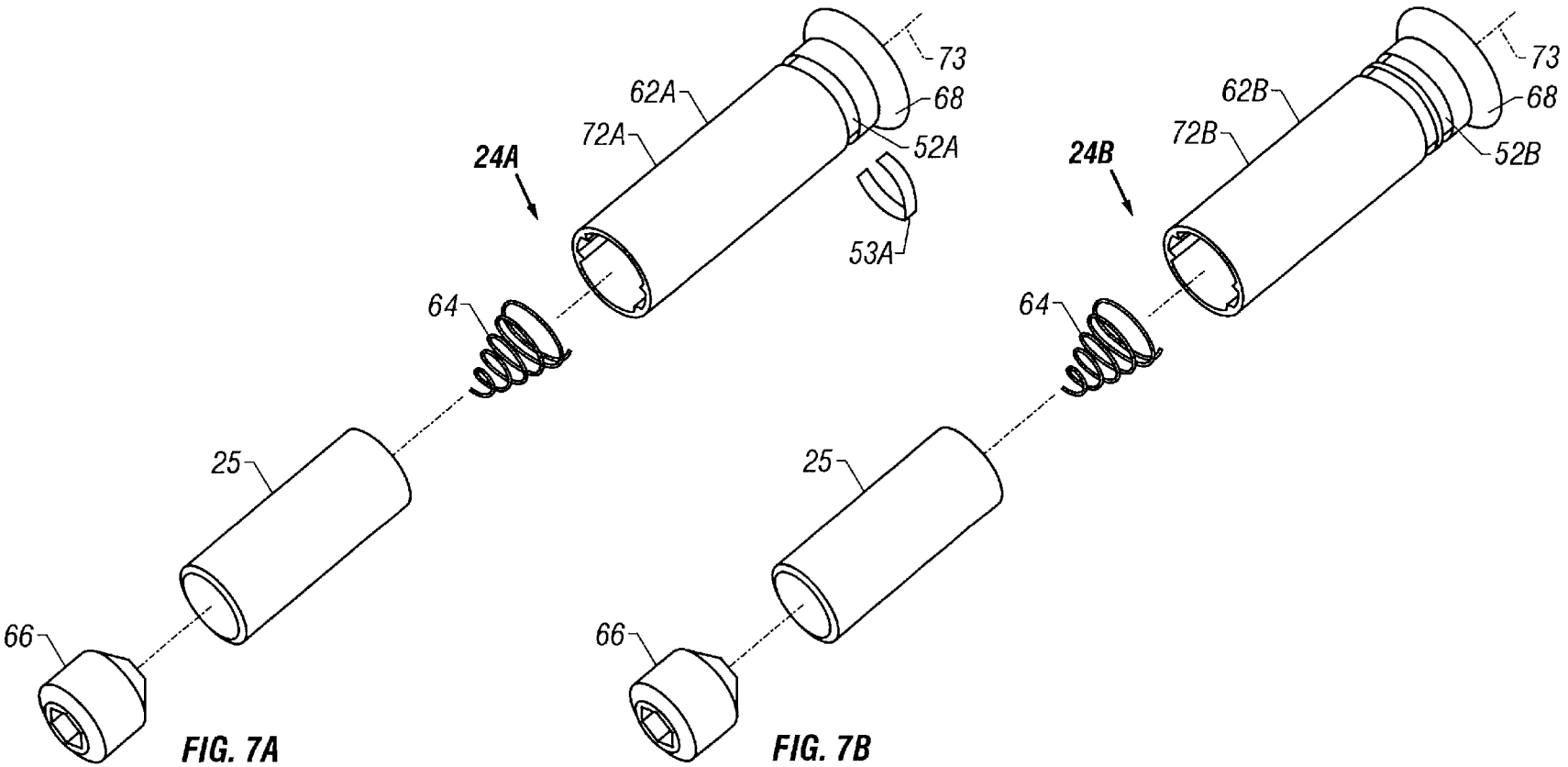
FIGS. 7A and 7B are assembly drawings of alternative embodiments of the magnet plug of FIG. 4.

FIG. 7A is an alternative embodiment of the magnet plug 24 of the present invention referred to by a reference number 24A. The magnet plug 24A includes the magnet 25, the spring 64, the plug 66, and the countersink head 68 as described above. The magnet plug 24A also includes a magnet plug housing 62A having a hollow cylindrical body 72A analogous to the housing 62 and body 72 described above. The body 72A includes an annular notch 52A. A spring clip 53A snaps into the annular notch 52A for retaining the magnet plug 24A to the hinge leaf 14.

FIG. 7B is another alternative embodiment of the magnet plug 24 of the present invention referred to by a reference number 24B. The magnet plug 24B includes the magnet 25, the spring 64, the plug 66, and the countersink head 68 as described above. The magnet plug 24B also includes a magnet plug housing 62B having a hollow cylindrical body 72B analogous to the housing 62 and body 72 described above. The body 72B includes exterior threads 52B for retaining the magnet plug 24B to the hinge leaf 14 by threading to the fastening hole 36B or to a nut capturing the hinge leaf 14 or to the doorjamb 46 behind the hinge leaf 14.

Figure 8A:
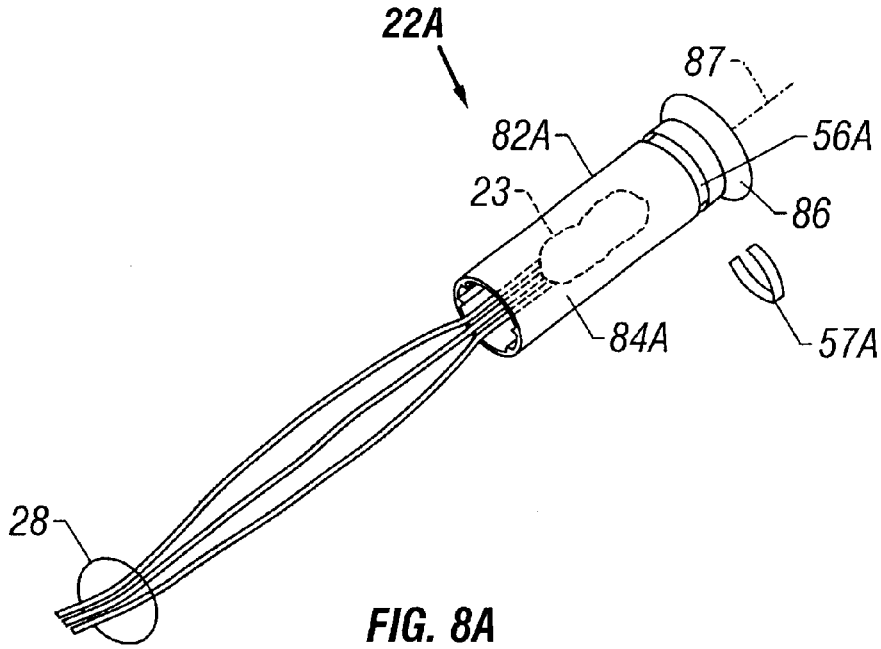
FIGS. 8A and 8B are drawings of alternative embodiments of the switch plug of FIG. 5.

FIG. 8A is an alternative embodiment of the switch plug 22 of the present invention referred to by a reference number 22A. The switch plug 22A includes the switch 23, and the countersink head 86 as described above. The switch plug 22A also includes a switch plug housing 82A having a cylindrical body 84A analogous to the housing 82 and body 84 described above. The body 82A includes an annular notch 56A. A spring clip 57A snaps into the annular notch 56A for retaining the switch plug 22A to the hinge leaf 12.

Figure 8B:
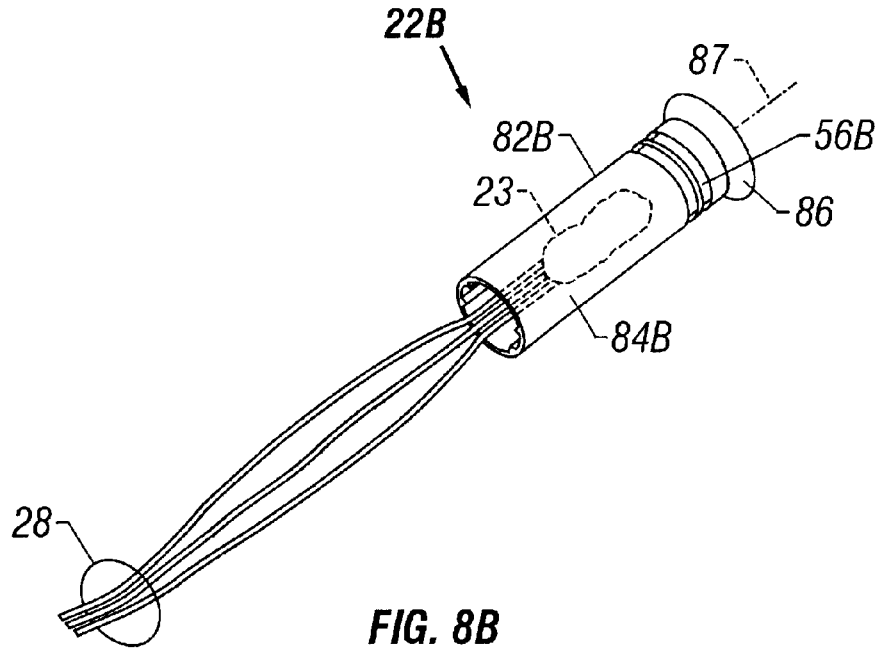

FIG. 8B is another alternative embodiment of the switch plug 22 of the present invention referred to by a reference number 22B. The switch plug 22B includes the switch 23, and the countersink head 86 as described above. The switch plug 22B also includes a switch plug housing 82B having a cylindrical body 84B analogous to the housing 82 and body 84 described above. The body 82B includes exterior threads 56B for retaining the switch plug 22B to the hinge leaf 12 by threading to the fastening hole 36A or to a nut capturing the hinge leaf 12 or to the wall jamb 44 behind the hinge leaf 12.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A monitor hinge comprising:

a standard hinge having hinge leaves having fastening holes, said hinge leaves connected for rotation;

a first plug having a magnetic field sensitive switch for insertion into an existing first of said fastening holes in a first of said hinge leaves; and a second plug having a magnet for insertion into an existing second of said fastening holes in a second of said hinge leaves.

2. The hinge of claim 1, wherein:

said first and said second plugs are disposed to be juxtaposed when said hinge leaves are rotated to a closed position.

3. The hinge of claim 1, wherein:

the first plug includes a cylindrical body for passing through said first fastening hole.

4. The hinge of claim 3, wherein:

said body includes exterior threads used for retaining the first plug to the hinge by threading into at least one of said first fastening hole and a hole in a hinge object aligned behind said first fastening hole.

5. The hinge of claim 3, wherein:

the first plug further includes a head for seating in a countersink of said first fastening hole, said body extending from said head.

6. The hinge of claim 5, wherein:

said body includes latch fingers projecting outward for latching against a back side of said first hinge leaf for retaining the first plug to said first hinge leaf by clamping said first hinge leaf between said fingers and said head.

7. The hinge of claim 6, wherein:

said latch fingers project to a radius of about 0.165 to 0.200 inches from a centerline of said body.

8. The hinge of claim 6, wherein:

said body includes an annular notch for accepting a snap spring for retaining the first plug to the hinge by clamping said first hinge leaf between said snap spring and said head.

9. The hinge of claim 5, wherein:

said head includes a cross notch.

10. The hinge of claim 1, wherein:

the first plug further includes a body, a spring and an end plug, said end plug threading into said body for pressing said switch into said spring for adjusting a rotation angle of the hinge where a magnetic field from said magnet switches said magnetic field sensitive switch.

11. The hinge of claim 1, wherein:

the second plug further includes a body, a spring and an end plug, said end plug threading into said body for pressing said magnet into said spring for adjusting a rotation angle of the hinge where a magnetic field from said magnet switches said magnetic field sensitive switch.

12. The hinge of claim 1, wherein:

the second plug includes a cylindrical body for passing through said second fastening hole.

13. The hinge of claim 12, wherein:

said body includes an annular notch for accepting a snap spring for retaining the second plug to the hinge by clamping said second hinge leaf between said snap spring and said head.

14. The hinge of claim 12, wherein:

said body includes exterior threads for retaining the second plug to the hinge by threading into at least one of said second fastening hole and a hole in a hinge object aligned behind said second fastening hole.

15. The hinge of claim 12, wherein:

the second plug further includes a head for seating in a countersink of said second fastening hole, said body extending from said head.

16. The hinge of claim 15, wherein:

said body includes latch fingers projecting outward from said second body for latching against a back side of said second hinge leaf for retaining the second plug to said second hinge leaf by clamping said second hinge leaf between said latch fingers and said head.

17. The hinge of claim 16, wherein:

said latch fingers project to a radius of about 0.165 to 0.200 inches from a centerline of said body.

18. The hinge of claim 16, wherein:

said head includes a cross notch.

19. A method for installation of a monitor hinge, comprising:

providing a standard hinge having hinge leaves having fastening holes;

installing said hinge by fastening said hinge leaves through at least one of said fastening holes in each of said leaves;

installing a first plug having a magnetic field sensitive switch in an existing first of said fastening holes in a first of said hinge leaves; and installing a second plug having a magnet in an existing second of said fastening holes in a second of said hinge leaves.

20. The method of claim 19, wherein:

said first and second plugs are disposed to be juxtaposed when said first and second leaves are rotated to a closed position.

21. The method of claim 19, wherein:

the step of installing said first plug includes drilling a first hole coaxial with said first fastening hole into a first object; and pushing a body of said first plug into said first hole.

22. The method of claim 21, wherein:

the step of installing said first plug further includes latching said first plug against a back side of said first hinge leaf with latch fingers projecting outward from said body said first plug retained to said hinge by clamping said first hinge leaf between said fingers and a countersink head of said first plug.

23. The method of claim 21, wherein:

the step of installing said first plug further includes retaining said first plug to said hinge by clamping said first hinge leaf between a countersink head of said first plug and a snap spring in a notch in said body.

24. The method of claim 21, wherein:

the step of installing said first plug further includes retaining said first plug to said hinge by threading said first plug into at least one of said first fastening hole and said first hole with exterior threads in said body.

25. The method of claim 19, wherein:

the step of installing said first plug further includes seating said first plug in a countersink of said first fastening hole.

26. The method of claim 19, further comprising:

adjusting a position of at least one of said switch and said magnet within said first plug and said second plug, respectively, for setting an angle of rotation of said hinge where a magnetic field from said magnet causes said switch to change state.

27. The method of claim 19, wherein:

the step of installing said second plug includes drilling a second hole coaxial with said second fastening hole into a second object; and pushing a body of said second plug into said second hole.

28. The method of claim 27, wherein:

the step of installing said second plug further includes latching said second plug against a backside of said second leaf with latch fingers projecting outward from said body, said second plug retained to said hinge by clamping said second hinge leaf between said fingers and a countersink head of said second plug.

29. The method of claim 27, wherein:

the step of installing said second plug further includes retaining said second plug to said hinge by clamping said second hinge leaf between a countersink head of said second plug and a snap spring in a notch in said body.

30. The method of claim 27, wherein:

the step of installing said second plug further includes retaining said second plug to said hinge by threading said second plug into at least one of said second fastening hole and said second hole with exterior threads in said body.

31. The method of claim 19, wherein:

the step of installing said second plug further includes seating said second plug in a countersink of said second fastening hole.

32. A monitor hinge kit, comprising:

a first plug having a magnetic field sensitive switch for insertion into an existing first fastening hole in a first hinge leaf of a standard hinge; and a second plug having a magnet for insertion into an existing second fastening hole in a second hinge leaf of said hinge.

33. The hinge kit of claim 32, wherein:

the first plug includes a cylindrical body for passing through said first fastening hole.

34. The hinge kit of claim 33, wherein:

the first plug further includes a head for seating in a countersink of said first fastening hole, said body extending from said head.

35. The hinge kit of claim 34, wherein:

said body includes latch fingers projecting outward for latching against a back side of said first hinge leaf for retaining the first plug to said first hinge leaf by clamping said first hinge leaf between said fingers and said head.

36. The hinge kit of claim 35, wherein:

said latch fingers project to a radius of about 0.165 to 0.200 inches from a centerline of said body.

37. The hinge kit of claim 34, wherein:

said body includes a notch for accepting a snap spring for retaining the first plug to the hinge by clamping said first hinge leaf between said snap spring and said head.

38. The hinge kit of claim 33, wherein:

said body includes exterior threads for retaining the first plug to the hinge by threading into at least one of said first fastening hole and a hole in a hinge object aligned behind said first fastening hole.

39. The hinge kit of claim 34, wherein:

said head includes a cross notch.

40. The hinge kit of claim 32, wherein:

the first plug further includes a body, a spring and an end plug, said end plug for threading into said body for pressing said switch into said spring for adjusting a rotation angle of the hinge where a magnetic field from said magnet switches said magnetic field sensitive switch.

41. The hinge kit of claim 32, wherein:

the second plug further includes a body, a spring and an end plug, said end plug threading into said body for pressing said magnet into said spring for adjusting a rotation angle of the hinge where a magnetic field from said magnet switches said magnetic field sensitive switch.

42. The hinge kit of claim 32, wherein:

the second plug includes a cylindrical body for passing through said second fastening hole.

43. The hinge kit of claim 42, wherein:

the second plug further includes a head for seating in a countersink of said second fastening hole, said body extending from said head.

44. The hinge kit of claim 43, wherein:

said body includes latch fingers projecting outward for latching against a back side of said second hinge leaf for retaining the second plug to said second hinge leaf by clamping said second hinge leaf between said latch fingers and said head.

45. The hinge kit of claim 43, wherein:

said body includes a notch for accepting a snap spring for retaining the second plug to the hinge by clamping said second hinge leaf between said snap spring and said head.

46. The hinge kit of claim 42, wherein:

said body includes exterior threads for retaining the second plug to the hinge by threading into at least one of said second fastening hole and a hole in a hinge object aligned behind said second fastening hole.

47. The hinge kit of claim 43, wherein:

said head includes a cross notch.

48. The hinge kit of claim 44, wherein:

said latch fingers project to a radius of about 0.165 to 0.200 inches from a centerline of said second body.

* * * * *